US011615737B2

(12) United States Patent
Kim et al.

(10) Patent No.: US 11,615,737 B2
(45) Date of Patent: Mar. 28, 2023

(54) DISPLAY DEVICE

(71) Applicant: Samsung Display Co., Ltd., Yongin-si (KR)

(72) Inventors: Yu Choi Kim, Yongin-si (KR); Joon Chui Goh, Yongin-si (KR); Jin Wook Yang, Yongin-si (KR); Bong Hyun You, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/447,792

(22) Filed: Sep. 15, 2021

(65) Prior Publication Data

US 2022/0139301 A1 May 5, 2022

(30) Foreign Application Priority Data

Nov. 5, 2020 (KR) ..... 10-2020-0147159

(51) Int. Cl.
*G09G 3/32* (2016.01)

(52) U.S. Cl.
CPC ..... *G09G 3/32* (2013.01); *G09G 2300/0842* (2013.01); *G09G 2310/0267* (2013.01);
(Continued)

(58) Field of Classification Search
CPC ..... G09G 3/3233; G09G 2320/043; G09G 2300/0861; G09G 3/3266; G09G 2310/0262; G09G 3/3258; G09G 2320/045; G09G 2300/0439; G09G 2320/0295; G09G 2320/0209; G09G 2320/0257; G09G 2320/029; G09G 2310/06;
(Continued)

(56) References Cited

U.S. PATENT DOCUMENTS 8,054,321 B2 11/2011 Cho et al.
8,994,619 B2 * 3/2015 Jeong ..... G09G 3/3233 345/82
(Continued)

FOREIGN PATENT DOCUMENTS

CN 111261102 A * 6/2020 ..... G09G 3/3208
KR 10-1089608 B1 12/2011
(Continued)

*Primary Examiner* — Duc Q Dinh
(74) *Attorney, Agent, or Firm* — Lewis Roca Rothgerber Christie LLP

(57) ABSTRACT

A display device includes pixels, and first, second, and third gate lines and data lines connected to the pixels. At least one of the pixels includes a light emitting element, a first transistor connected between a first power source and the light emitting element for driving the light emitting element according to a voltage of a first node, a second transistor connected between the first node and a corresponding data line, and driven according to a voltage of a corresponding first gate line, a capacitor connected between the first node and a second node between the first transistor and the light emitting element, a third transistor between the second node and an initialization power line, and driven according to a voltage of a corresponding second gate line, and a fourth transistor connected between the first and second nodes, and driven according to a voltage of a corresponding third gate line.

13 Claims, 11 Drawing Sheets

120: 120A, 120B

(52) U.S. Cl.
CPC . *G09G 2310/0275* (2013.01); *G09G 2310/08* (2013.01); *G09G 2320/0257* (2013.01)

(58) Field of Classification Search
CPC ..... G09G 2320/0214; G09G 3/32; G09G 2300/0842; G09G 2310/0267; G09G 2310/0275; G09G 2310/08; G09G 2310/0251; G09G 2300/0819; G09G 3/3275; G09G 2320/0247; G09G 2300/0809; G09G 2330/021; H01L 27/3265; H01L 27/3262; H01L 27/3244; H01L 2924/13069; H01L 51/5012; H01L 27/1244; G09F 9/33
See application file for complete search history.

(56) References Cited

U.S. PATENT DOCUMENTS

| | | | | |
|---|---|---|---|---|
| 9,224,329 | B2 * | 12/2015 | Kim | G09G 3/3233 |
| 10,311,788 | B2 | 6/2019 | Lim et al. | |
| 2009/0251496 | A1 * | 10/2009 | Saito | G09G 3/3283 345/690 |
| 2010/0265166 | A1 * | 10/2010 | Kang | G09G 3/3233 345/76 |
| 2014/0354517 | A1 * | 12/2014 | Chung | G09G 3/3233 345/76 |
| 2015/0187273 | A1 | 7/2015 | Chang et al. | |
| 2015/0187276 | A1 * | 7/2015 | Shim | G09G 3/3291 345/77 |
| 2017/0249902 | A1 | 8/2017 | Park et al. | |
| 2017/0278459 | A1 * | 9/2017 | Jeon | G09G 3/3291 |
| 2019/0096337 | A1 * | 3/2019 | Zhu | G09G 3/3258 |
| 2019/0180688 | A1 * | 6/2019 | Yang | G09G 3/3233 |
| 2020/0043420 | A1 * | 2/2020 | Kang | G09G 3/3225 |

FOREIGN PATENT DOCUMENTS

| | | | |
|---|---|---|---|
| KR | 10-1146408 | B1 | 5/2012 |
| KR | 10-1806502 | B1 | 12/2017 |
| KR | 10-2018-0061546 | A | 6/2018 |

* cited by examiner

120: 120A, 120B

DISPLAY DEVICE

CROSS-REFERENCE TO RELATED APPLICATION

This application claims priority to, and the benefit of, Korean Patent Application No. 10-2020-0147159 filed in the Korean Intellectual Property Office on Nov. 5, 2020, the entire contents of which are incorporated herein by reference.

BACKGROUND

1. Field

Embodiments of the present disclosure relate to a display device.

2. Description of the Related Art

Recently, interest in information display has been increasing. Accordingly, research and development on display devices are continuously being conducted.

SUMMARY

An aspect of the present disclosure provides a display device capable of reducing or preventing an afterimage.

The aspects of the present disclosure are not limited to the above aspect, and other aspects that are not mentioned herein will be clearly understood by those of ordinary skill in the art from the following description.

A display device according to some embodiments of the present disclosure includes pixels, first gate lines, second gate lines, and third gate lines connected to the pixels, and data lines connected to the pixels, wherein at least one of the pixels includes a light emitting element connected between a first power source and a second power source, a first transistor connected between the first power source and the light emitting element for driving the light emitting element according to a voltage of a first node, a second transistor connected between the first node and a corresponding data line, and configured to be driven according to a voltage of a corresponding first gate line, a capacitor connected between the first node and a second node that is between the first transistor and the light emitting element, a third transistor connected between the second node and an initialization power line, and configured to be driven according to a voltage of a corresponding second gate line, and a fourth transistor connected between the first node and the second node, and configured to be driven according to a voltage of a corresponding third gate line.

The fourth transistor may be directly connected between a first electrode and a second electrode of the capacitor, and is configured to connect the first electrode and the second electrode of the capacitor during a period in which a third gate signal is supplied to the corresponding third gate line.

The display device may further include a gate driver for supplying first gate signals, second gate signals, and third gate signals to the first gate lines, the second gate lines, and the third gate lines, respectively, wherein the pixels are arranged on horizontal lines, wherein the first gate lines, the second gate lines and the third gate lines are arranged on respective horizontal lines and are connected to the pixels of the respective horizontal lines, and wherein the gate driver is configured to concurrently supply the first and second gate signals to respective first and second gate lines of the horizontal lines for respective horizontal periods constituting one frame period.

The gate driver may be configured to sequentially supply the first and second gate signals to the respective first and second gate lines of the horizontal lines in respective units of one of the horizontal lines during the one frame period.

The gate driver may be configured to, for one of the horizontal lines, supply a corresponding third gate signal to the corresponding third gate line when a time elapses after a corresponding first gate signal and a corresponding second gate signal are supplied to the corresponding first gate line and the corresponding second gate line during the one frame period.

The gate driver may be configured to sequentially supply the third gate signals to the third gate lines of the horizontal lines in respective units of at least one of the horizontal lines during the one frame period.

The gate driver may include a first gate driver for supplying the first and second gate signals to the first and second gate lines of the horizontal lines, and a second gate driver for supplying the third gate signals to the third gate lines of the horizontal lines.

The display device may further include a data driver for supplying data signals corresponding to the pixels of a respective one of the horizontal lines to the data lines for a respective one of the horizontal periods.

A display device according to some embodiments of the present disclosure includes pixels, first gate lines, second gate lines, and third gate lines connected to the pixels, and data lines connected to the pixels, wherein at least one of the pixels includes a light emitting element connected between a first power source and a second power source, a first transistor connected between the first power source and the light emitting element for driving the light emitting element according to a voltage of a first node, a second transistor connected between the first node and a corresponding data line, and configured to be driven according to a voltage of a corresponding first gate line, a capacitor connected between the first node and a second node that is between the first transistor and the light emitting element, a third transistor connected between the second node and an initialization power line, and configured to be driven according to a voltage of a corresponding second gate line, and a fourth transistor connected between the first node and a bias power line separated from the initialization power line, and configured to be driven according to a voltage of a corresponding third gate line.

The fourth transistor may be directly connected between the first node and the bias power line, and is configured to transmit a voltage of a bias power source to the first node during a period in which a third gate signal is supplied to the corresponding third gate line.

The voltage of the bias power source may be configured to be set to an off voltage of the first transistor, or to a low gray scale voltage that is less than or equal to a reference gray scale.

The display device may further include a gate driver for supplying first gate signals, second gate signals, and third gate signals to the first gate lines, the second gate lines, and the third gate lines, respectively, wherein the pixels are arranged on horizontal lines, wherein the first gate lines, the second gate lines and the third gate lines are arranged on respective horizontal lines and are connected to the pixels of the respective horizontal lines, and wherein the gate driver is configured to concurrently supply the first and second gate signals to respective first and second gate lines of the horizontal lines for respective horizontal periods constituting one frame period.

The gate driver may be configured to sequentially supply the first and second gate signals to the respective first and second gate lines of the horizontal lines in respective units of one of the horizontal lines during the one frame period.

The gate driver may be configured to, for one of the horizontal lines, supply a corresponding third gate signal to the corresponding third gate line when a time elapses after a corresponding first gate signal and a corresponding second gate signal are supplied to the corresponding first gate line and the corresponding second gate line during the one frame period.

The gate driver may be configured to sequentially supply the third gate signals to the third gate lines of the horizontal lines in respective units of at least one of the horizontal lines during the one frame period.

The gate driver may include a first gate driver for supplying the first and second gate signals to the first and second gate lines, and a second gate driver for supplying the third gate signals to the third gate lines.

The display device may further include a data driver for supplying data signals corresponding to pixels of a respective one of the horizontal lines to the data lines for a respective one of the horizontal periods.

Detailed matters of other embodiments are incorporated in the detailed description and drawings.

DETAILED DESCRIPTION

Figure 1:
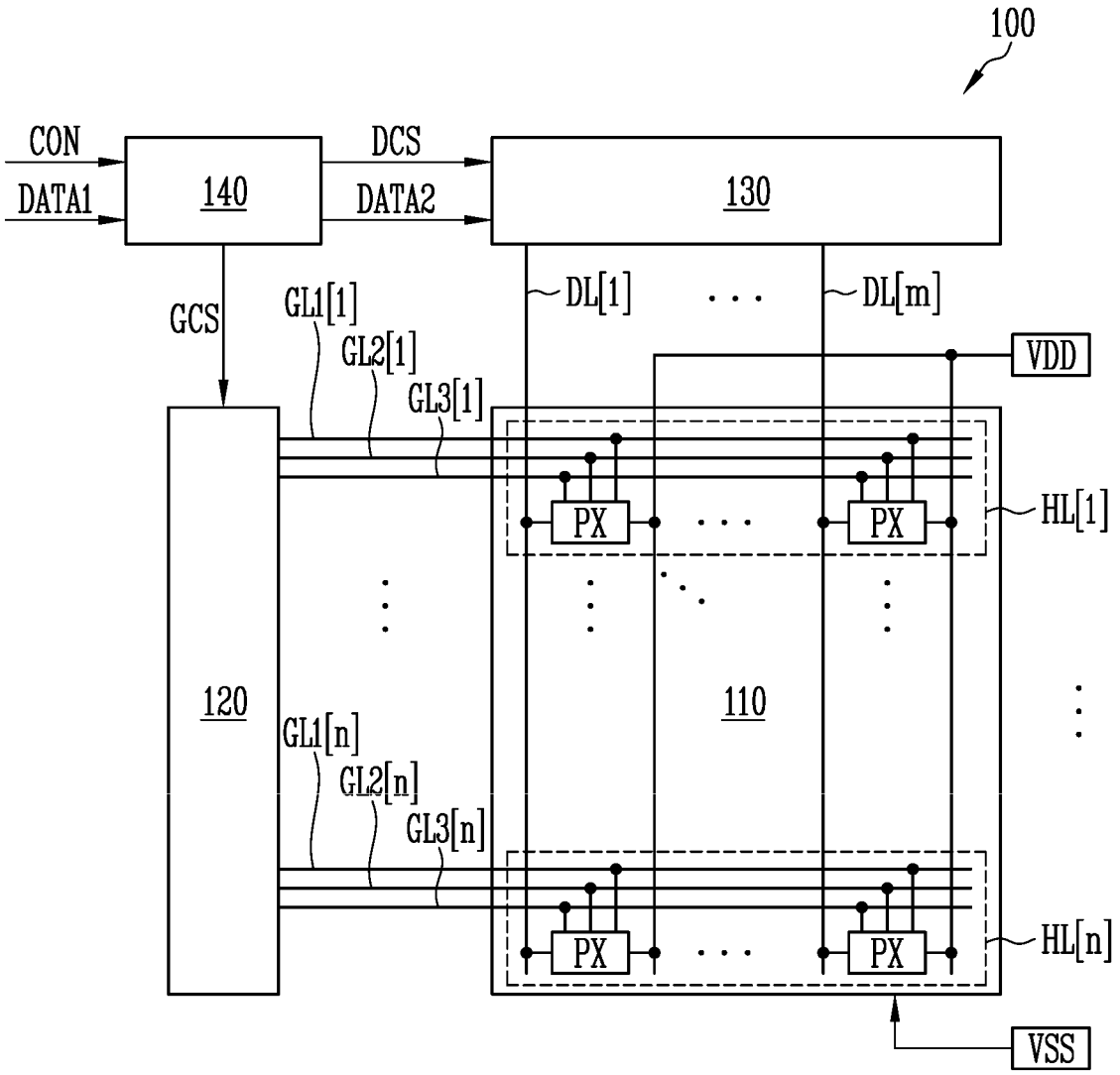
FIG. 1 illustrates a display device according to some embodiments of the present disclosure.

Aspects of some embodiments of the present disclosure and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects of the present disclosure to those skilled in the art. Accordingly, processes, elements, and techniques that are not necessary to those having ordinary skill in the art for a complete understanding of the aspects of the present disclosure may not be described.

Unless otherwise noted, like reference numerals, characters, or combinations thereof denote like elements throughout the attached drawings and the written description, and thus, descriptions thereof will not be repeated. Further, parts not related to the description of the embodiments might not be shown to make the description clear.

In the drawings, the relative sizes of elements, layers, and regions may be exaggerated for clarity. Additionally, the use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified.

Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that when an element, layer, region, or component is referred to as being "formed on," "on," "connected to," or "coupled to" another element, layer, region, or component, it can be directly formed on, on, connected to, or coupled to the other element, layer, region, or component, or indirectly formed on, on, connected to, or coupled to the other element, layer, region, or component such that one or more intervening elements, layers, regions, or components may be present. For example, when a layer, region, or component is referred to as being "electrically connected" or "electrically coupled" to another layer, region, or component, it can be directly electrically connected or coupled to the other layer, region, and/or component or intervening layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z," "at least one of X, Y, or Z," and "at least one selected from the group consisting of X, Y, and Z" may be construed as X only, Y only, Z only, any combination of two or more of X, Y, and Z, such as, for instance, XYZ, XYY, YZ, and ZZ, or any variation thereof. Similarly, the expression such as "at least one of A and B" may include A, B, or A and B. As used herein, the term "and/or" includes any and all combinations of one or more of the associated listed items. For example, the expression such as "A and/or B" may include A, B, or A and B.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When one or more embodiments may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
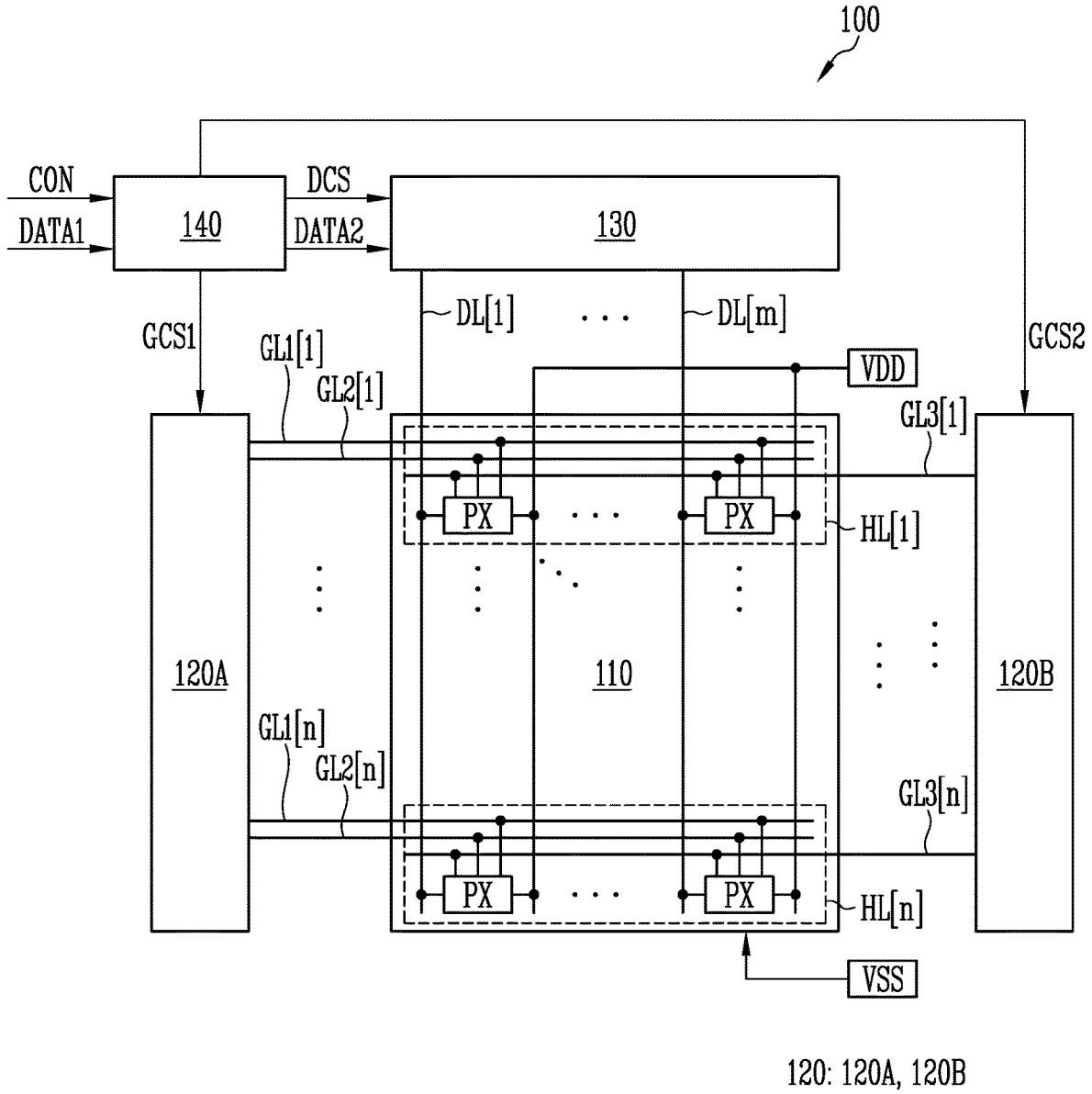
FIG. 2 illustrates a display device according to some embodiments of the present disclosure.

FIGS. 1 and 2 illustrate display devices 100 according to some embodiments of the present disclosure, respectively. Compared with FIG. 1, FIG. 2 illustrates other embodiments of a gate driver 120.

Referring to FIGS. 1 and 2, the display device 100 according to some embodiments of the present disclosure includes a display area 110 in which pixels PX are arranged (or a display panel including the display area 110), and a gate driver 120, a data driver 130, and a controller 140 for driving the pixels PX.

The display area 110 includes pixels PX arranged on a plurality of horizontal lines HL[1] to HL[n] (where n is a natural number of 2 or more). In addition, the display area 110 includes first gate lines GL1[1] to GL1[*n*], second gate lines GL2[1] to GL2[*n*], and third gate lines GL3[1] to GL3[*n*], which are formed for each horizontal line, and data lines DL[1] to DL[m] (where m is a natural number of 2 or more), which are formed for each vertical line. For example, a j-th first gate line GL1[*j*], a j-th second gate line GL2[*j*], and a j-th third gate line GL3[*j*] may be provided on a j-th horizontal line (where j is a natural number), and a k-th data line DL[k] may be provided on a k-th vertical line (where k is a natural number).

For convenience, in describing the following embodiments, at least one first gate line is arbitrarily or generically referred to as "first gate line(s) GL1", at least one second gate line is arbitrarily or generically referred to as "second gate line(s) GL2", and at least one third gate line is arbitrarily or generically referred to "third gate line(s) GL3". Similarly, at least one data line is arbitrarily or generically referred to as "data line(s) (DL)". In addition, at least one horizontal line is arbitrarily referred to as "horizontal line(s) (HL)".

The pixels PX may be respectively connected to the first, second, and third gate lines GL1, GL2, and GL3 provided on each horizontal line HL, and to the data line DL provided on each vertical line. For example, the pixel PX located on the j-th horizontal line HL[j] and the k-th vertical line may be connected to the j-th first, second, and third gate lines GL1[*j*], GL2[*j*], and GL3[*j*] and the k-th data line DL[k]. In describing the embodiments of the present disclosure, the term "connection (or coupling)" may comprehensively mean a physical and/or electrical connection (or coupling). In addition, the term "connection (or coupling)" may comprehensively mean a direct or indirect connection (or coupling), and an integrated or non-integrated connection (or coupling).

The pixels PX receive first, second, and third gate signals from the first, second, and third gate lines GL1, GL2, and GL3, respectively. The first, second, and third gate signals may be control signals for controlling operation timings of the pixels PX, and may be scan signals for controlling timings for supplying data signals to the pixels PX of each horizontal line HL.

For example, the first gate signal may be a scan signal for selecting (for example, sequentially selecting) the pixels PX in units of horizontal lines to supply data signals to the pixels PX of each horizontal line. In this case, the first gate line GL1 may be a scan line of each horizontal line.

The second gate signal may be an initialization control signal for supplying a voltage of an initialization power source to the pixels PX of each horizontal line during a display period in which the pixels PX are driven. In addition, in some embodiments, the second gate signal may also be used as a sensing control signal for connecting the pixels PX of each horizontal line to the sensing unit during a sensing period (e.g., a predetermined sensing period) for extracting characteristic information of the pixels PX.

The third gate signal may be a non-emission control signal for controlling the pixels PX of each horizontal line not to emit light, or for driving the pixels PX of each horizontal line with a low gray scale below a reference gray scale (e.g., predetermined reference gray scale) during a display period in which the pixels PX are driven.

The pixels PX receive data signals of each frame from each data line DL. During a display period in which the display device 100 displays an image by the pixels PX, the emission luminance of the pixels PX may be controlled during each frame period by the data signals of each frame.

In addition, the pixels PX may be connected to at least one driving power source. For example, the pixels PX may be connected to a first power source VDD as a high potential pixel power source, and a second power source VSS as a low potential pixel power source. In addition, the pixels PX may be further connected to at least one other driving power source. For example, the pixels PX may be further connected to at least one of an initialization power source and/or a bias power source.

The pixels PX receive the first and second gate signals from the first and second gate lines GL1 and GL2 for each frame period during the display period for displaying an image corresponding to input data. In addition, the pixels PX receive data signals corresponding to input data of each frame from the data lines DL during a period in which the first and second gate signals are supplied, and emit light with a luminance corresponding to the data signals to display an image of each frame.

In addition, the pixels PX may receive the third gate signals from the third gate lines GL3 in each frame period. The pixels PX of each horizontal line might not emit light, or may be driven in a low gray scale that is less than a reference gray scale (e.g., predetermined reference gray scale), in response to the third gate signal supplied to the third gate line GL3 of the horizontal line HL. For example, the pixels PX may display a black image or a dark image of a gray scale (e.g., a predetermined gray scale) by the third gate signal.

In some embodiments, the first and second gate lines GL1 and GL2 may be sequentially driven in units of horizontal lines HL. The third gate lines GL3 may also be sequentially driven in units of horizontal lines HL. In this case, after the first and second gate lines GL1 and GL2 are first driven for each horizontal line HL, the third gate line GL3 may be driven when a time (e.g., a predetermined time) elapses. That the first, second, and third gate lines GL1, GL2, and GL3 are driven may mean that the first, second, and third gate signals are supplied to the first, second, and third gate lines GL1, GL2 and GL3, respectively. In addition, each of the first, second, and third gate signals may refer to a signal or pulse having a gate-on voltage.

For example, in each frame period, the pixels PX may store the data signals of the corresponding frame by the first and second gate signals, may emit light during a period (e.g., a predetermined period) with each luminance corresponding to the data signals, and may sequentially switch to the non-emission state in units of horizontal lines. Meanwhile, in the case of the pixel PX that receives the data signal corresponding to the black gray scale (e.g., gray scale (0 gray) of the black data included in the first or second image data DATA1 and DATA2) during a corresponding frame period, a first transistor M1 is turned off by the data signal, and the pixel PX substantially maintains the non-emission state during the emission period of the corresponding frame period, thereby expressing the black gray scale.

In some embodiments, the pixels PX may be self-luminous pixels each including at least one light emitting element, but the present disclosure is not limited thereto. For example, the type, structure, and/or driving method of the pixels PX may be variously changed according to embodiments. A detailed description of the structure and driving method of the pixels PX will be described later.

The gate driver 120 receives the gate control signal GCS from the controller 140, and supplies the first, second, and third gate signals to the first, second, and third gate lines GL1, GL2, and GL3 in response to the gate control signal GCS. For example, the gate driver 120 may receive the gate control signal GCS including start signals for controlling the supply timing of the first, second, and third gate signals (e.g., a first sampling pulse input to a first shift register for generating a first gate signal, a second sampling pulse input to a second shift register for generating a second gate signal, and a third sampling pulse input to a third shift register for generating a third sampling pulse) and clock signals (e.g., clock signals for controlling the operation timing of the first, second, and third shift registers), and may supply the first, second, and third gate signals to the first, second, and third gate lines GL1, GL2, and GL3 in response to the gate control signal GCS.

In some embodiments, the gate driver 120 may simultaneously or substantially simultaneously (e.g., concurrently) supply the first and second gate signals to the first and second gate lines GL1 and GL2 of the horizontal line HL corresponding to the horizontal period for each horizontal period constituting one frame period, and may sequentially supply the first and second gate signals to the first and second gate lines GL1 and GL2 arranged in the display area 110 in units of one horizontal line HL during the one frame period.

In addition, the gate driver 120 may supply the third gate signal to the third gate line GL3 of the horizontal line at a time point when a time (e.g., a predetermined time) elapses after the first and second gate signals are supplied to the first and second gate lines GL1 and GL2 for each horizontal line during one frame period, and may sequentially supply the third gate signal to the third gate lines GL3 arranged in the display area 110 in units of one horizontal line HL (or one horizontal line group including at least two horizontal lines HL) during the one frame period. For example, after the first and second gate signals are simultaneously or substantially simultaneously supplied to the first and second gate lines GL1 and GL2 for each horizontal line during each frame period, the third gate signal may be supplied to the third gate line GL3.

In some embodiments, the gate driver 120 may include a first shift register for driving the first gate lines GL1, a second shift register for driving the second gate lines GL2, and a third shift register for driving the third gate lines GL3. For example, when the first and second gate lines GL1 and GL2 may be simultaneously or substantially simultaneously driven, or may be driven at different timings, according to the operation mode of the display device 100, the first shift register for driving the first gate lines GL1 and the second shift register for driving the second gate lines GL2 may be independently configured, and may be driven by each gate control signal GCS. For example, when the second gate lines GL2 are used in the sensing operation for sensing characteristic information of the pixels PX, the first and second shift registers may be independently configured.

In other embodiments, the first shift register for driving the first gate lines GL1 and the second shift register for driving the second gate lines GL2 may be integrated into one shift register. For example, when the first and second gate lines GL1 and GL2 are simultaneously or substantially simultaneously driven regardless of the operation mode of the display device 100, the first and second gate lines GL1 and GL2 of each horizontal line may be connected integrally or non-integrally, and may be simultaneously or substantially simultaneously driven by one shift register.

The configuration of the gate driver 120 may be variously changed according to embodiments. For example, the gate driver 120 may be integrated into a single driving circuit, or may be divided into a plurality of driving circuits.

In some embodiments, as illustrated in FIG. 1, the first, second, and third shift registers for driving the first, second, and third gate lines GL1, GL2, and GL3 may be integrated into a single gate driver 120.

In other embodiments, as illustrated in FIG. 2, the gate driver 120 may be divided into a first gate driver 120A and a second gate driver 120B, and each of the first gate driver 120A and the second gate driver 120B may include at least one shift register. As an example, the first gate driver 120A may include first and second shift registers for driving the first and second gate lines GL1 and GL2, and the second gate driver 120B may include a third shift register for driving the third gate lines GL3. In this case, the first gate driver 120A and the second gate driver 120B may be supplied with, and driven by, a first gate control signal GCS1 and a second gate control signal GCS2 from the controller 140, respectively.

The data driver 130 receives a data control signal DCS and second image data DATA2 from the controller 140, and generates data signals in response to the data control signal DCS and the second image data DATA2. For example, the data driver 130 may receive second image data DATA2 together with a data control signal DCS including a source sampling pulse, a source sampling clock, and/or a source output enable signal, and may generate data signals corresponding to the second image data DATA2. In some embodiments, the data signals may be generated in the form of a data voltage corresponding to luminance to be displayed by the pixels PX, but the present disclosure is not limited thereto.

The data driver 130 may supply the data signals to the pixels PX through the data lines DL. For example, the data driver 130 may supply the data signals corresponding to the pixels PX of the horizontal line HL corresponding to the horizontal period to the data lines DL for each horizontal period constituting one frame period. The data signals supplied to the data lines DL are supplied to the pixels PX of the horizontal line HL selected by the first gate signal.

The controller 140 receives control signals CON and first image data DATA1 from the outside (e.g., a host processor), and may drive the gate driver 120 and the data driver 130 in response to the control signals CON and the first image data DATA1.

For example, the controller 140 may receive the control signals CON including a vertical synchronization signal, a horizontal synchronization signal, and/or a main clock signal, and may generate a gate control signal GCS and a data control signal DCS in response to the control signals CON. The gate control signal GCS may be supplied to the gate driver 120, and the data control signal DCS may be supplied to the data driver 130.

In addition, the controller 140 receives first image data DATA1 (e.g., input image data) from the outside (e.g., from a host processor), and may generate second image data DATA2 by converting and/or rearranging the first image data DATA1 according to the specifications of the display device 100.

The second image data DATA2 is supplied to the data driver 130 and is used to generate data signals. Therefore, an image corresponding to the second image data DATA2 may be displayed in the display area 110.

In some embodiments, the display device 100 may further include a sensing unit for sensing characteristic information of the pixels PX during a sensing period (e.g., a predetermined sensing period), and may store a compensation value to compensate characteristic deviation of the pixels PX sensed using the sensing unit. In this case, the controller 140 may convert the first image data DATA1 into the second image data DATA2 by applying the compensation value. Therefore, characteristic deviation of the pixels PX is compensated, and thus an image of uniform quality may be displayed in the display area 110.

Figure 3:
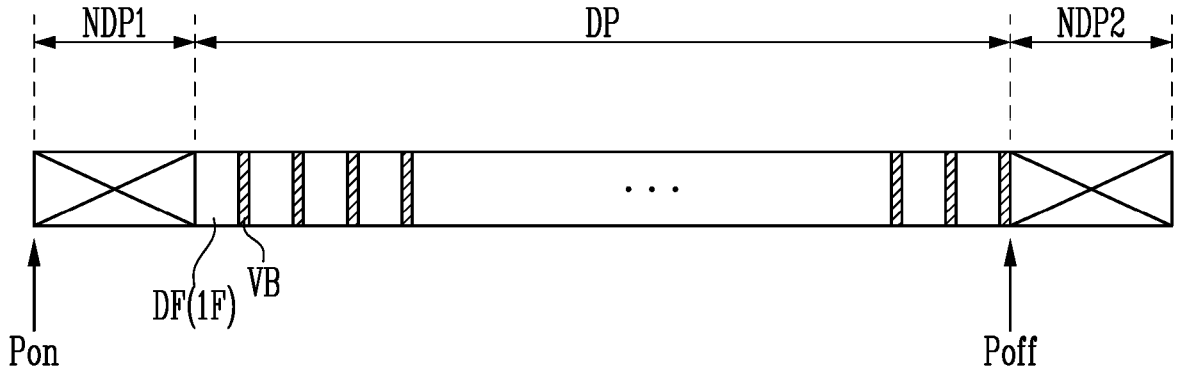
FIG. 3 illustrates a driving period of a display device according to some embodiments of the present disclosure.

FIG. 3 illustrates a driving period of a display device 100 according to some embodiments of the present disclosure.

Referring to FIGS. 1 to 3, the driving period of the display device 100 according to some embodiments of the present disclosure includes first and second non-display periods NDP1 and NDP2 and a display period DP. The display period DP is a period in which the pixels PX are driven in response to input image data (e.g., first image data DATA1), and may include at least one frame period DF. The first and second non-display periods NDP1 and NDP2 may include periods other than the display period DP among the driving periods of the display device 100.

The first non-display period NDP1 may be a period in which the display device 100 prepares for driving. As an example, the first non-display period NDP1 may be a period including tens to hundreds of frame periods from a time point when a power-on command Pon of the display device 100 is input.

The second non-display period NDP2 may be a period in which the driving of the display device 100 is ended. As an example, the second non-display period NDP2 may be a period including tens to hundreds of frame periods from a time point when a power-off command Poff of the display device 100 is input.

In some embodiments, the sensing operation for sensing characteristic information of the pixels PX may be performed in the first and/or second non-display periods NDP1 and NDP2. The sensed characteristic information may be used to convert input image data (e.g., first image data DATA1) so as to compensate characteristic deviation of the pixels PX during the display period DP.

However, the present disclosure is not limited thereto. For example, in other embodiments, characteristic information of the pixels PX may be sensed in real time within the display period DP and may be used to convert input image data.

The display period DP is a period in which the pixels PX are driven in correspondence with the input image data of each frame, and may be a period in which an image corresponding to the input image data is displayed in the display area 110. The display period DP may include frame periods DF (also referred to as a "display frame periods") for displaying an image of each frame, and a vertical blank period VB located between the frame periods DF. For example, whenever one frame period 1F is ended, the vertical blank period VB may start. For example, after the data input period of each frame period DF is ended, each vertical blank period VB may start.

Figure 4:
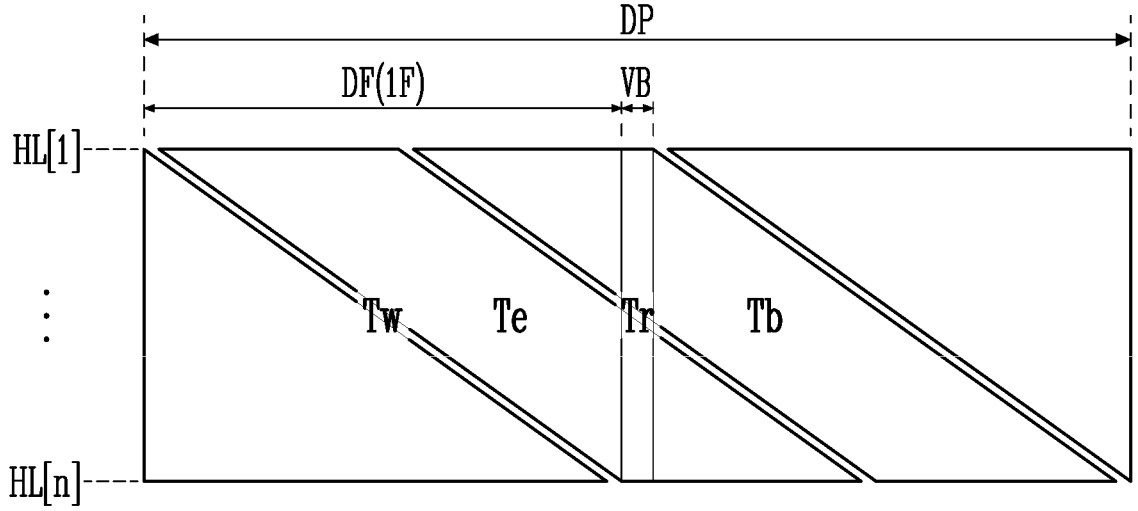
FIG. 4 illustrates a display period of a display device according to some embodiments of the present disclosure.

FIG. 4 illustrates the display period DP of the display device 100 according to some embodiments of the present disclosure. For convenience, FIG. 4 illustrates each frame period DF included in the display period DP based on the first horizontal line HL[1].

Referring to FIGS. 1 to 4, each frame period DF may include a data input period Tw, an emission period Te, a data reset period Tr, and a non-emission period Tb (also referred to as a "black frame period" or a "black insertion period"). In addition, each frame period DF may be sequentially started from the first horizontal line HL[1] to the n-th horizontal line HL[n] (e.g., the last horizontal line) of the display area 110.

For example, one frame period 1F may include a plurality of horizontal periods corresponding to the first to n-th horizontal lines HL[1] to HL[n], and the pixels PX of the corresponding horizontal line HL may be selected by the first gate signal during each horizontal period. In this manner, the pixels PX of the first to n-th horizontal lines HL[1] to HL[n] may be sequentially selected to receive data signals of each frame, and may sequentially emit light with luminance corresponding to the data signals. In addition, during the one frame period 1F, when the first to n-th horizontal lines HL[1] to HL[n] are sequentially selected at a time point when the pixels PX of each horizontal line HL emit light during a certain period, an off voltage or a voltage of a bias power source (e.g., a predetermined bias power source) may be sequentially input to the pixels PX of each horizontal line HL (for example, gate nodes of the driving transistors provided in the pixels PX). When the off voltage or the voltage of the bias power source is transmitted to the pixels PX, the pixels PX might not emit light, or may be driven with a low gray scale less than or equal to a reference gray scale (e.g., predetermined reference gray scale).

Therefore, the pixels PX may display images corresponding to the data signals during an emission period (e.g., a predetermined emission period) Te in one frame period 1F, and might not emit light, or may finely emit light with a low gray scale that is less than or equal to the reference gray scale during a non-emission period Tb subsequent to the emission period Te. The non-emission period Tb of the pixels PX may be maintained until data signals of a next frame are supplied.

In this manner, after the images corresponding to the data signals are displayed during each frame period DF, the images are erased by causing the pixels PX not to emit light, or by causing the pixels PX to finely emit light, thereby reducing or preventing an afterimage occurring in the display area 110. For example, even when the display device 100 displays a video at high speed, motion blur may be effectively prevented or reduced through an erasing operation performed after each emission period Te.

In addition, when the erase operation is performed by sequentially causing the pixels PX not to emit light (or finely emit light) in units of each horizontal line HL, the data reset period Tr and/or the non-emission period Tb may be performed for the at least one other horizontal line HL during the data input period Tw and/or the emission period Te for at least one horizontal line HL. In this case, the pixels PX may sequentially emit light without applying a simultaneous light emission method in which the pixels PX arranged in the display area 110 emit light at once. Therefore, the load of the display panel may be distributed and an instantaneous current of the display panel may be slowed or prevented from rapidly increasing.

In addition, in some embodiments of the present disclosure, the third gate signals are supplied to the pixels PX separately from the first and second gate signals, and the data reset period Tr and the non-emission period Tb of the pixels PX located on each horizontal line HL are controlled by the third gate signals. Therefore, regardless of the data input period Tw of the pixels PX located on each horizontal line HL, the pixels PX may be turned off (e.g., might not emit light) or may be driven with a low gray scale at a desired time point. Therefore, the image quality of the display device 100 may be improved by reducing or preventing an afterimage while sufficiently securing the data input period Tw and the emission period Te. In addition, the ratio of the data reset period Tr to the non-emission period Tb for each horizontal line HL may be freely adjusted by the third gate signals.

Meanwhile, each vertical blank period VB might not overlap the data input periods Tw of the horizontal lines HL. For example, after the data input period Tw for all horizontal lines HL is ended during each frame period DF, the vertical blank period VB may start. In some embodiments, each vertical blank period VB may overlap the emission period Te, the data reset period Tr, and/or the non-emission period Tb for at least some horizontal lines HL, but the present disclosure is not limited thereto.

Figure 5:
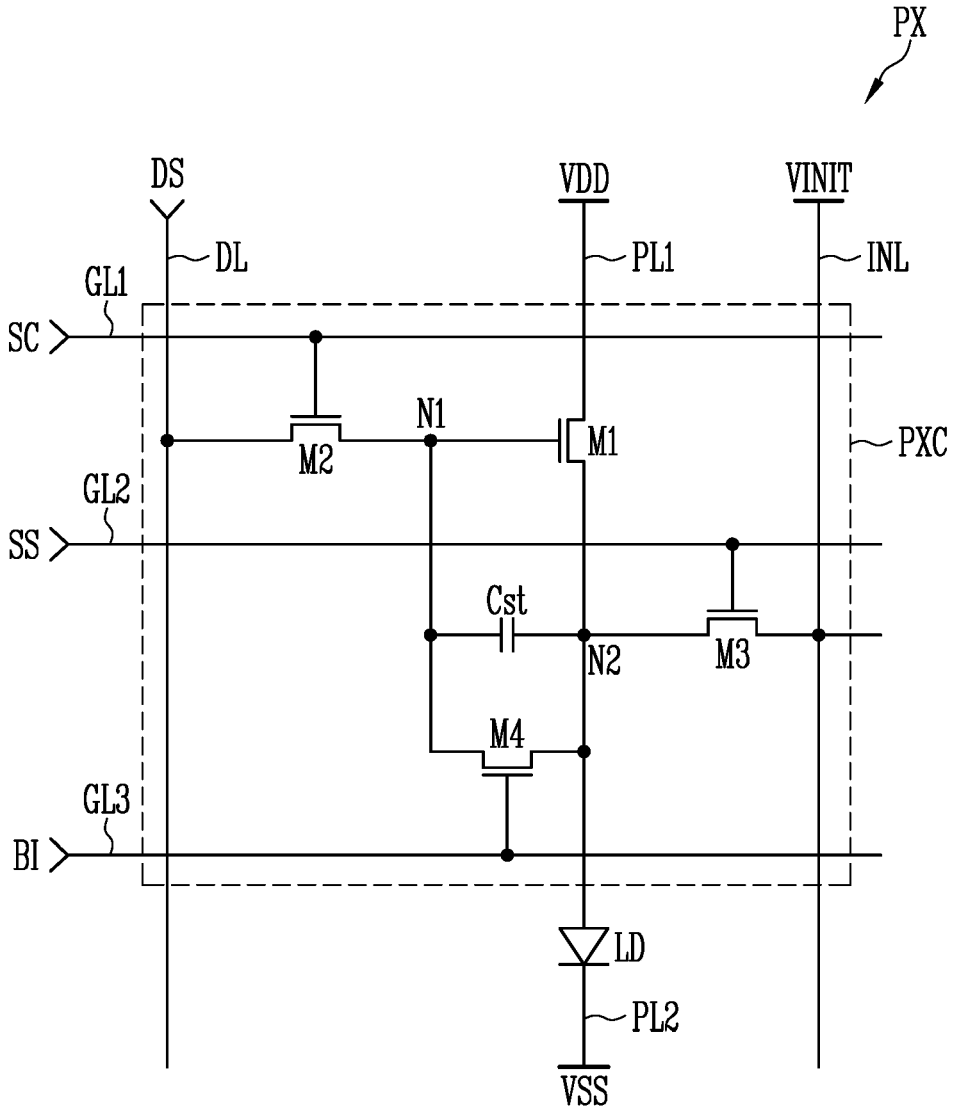
FIG. 5 illustrates a pixel according to some embodiments of the present disclosure.

FIG. 5 illustrates a pixel PX according to some embodiments of the present disclosure. For example, FIG. 5 illustrates an example of the pixel PX that may be located in the display area 110 of FIGS. 1 and 2, and the pixels PX located in the display area 110 may have substantially the same or similar structure.

Referring to FIGS. 1 to 5, the pixel PX according to some embodiments of the present disclosure includes a light emitting element LD and a pixel circuit PXC for driving the light emitting element LD.

The light emitting element LD is connected between a first power source VDD and a second power source VSS. For example, one electrode (e.g., an anode electrode) of the light emitting element LD may be connected to the first power source VDD through a pixel circuit PXC and a first power line PL1, and another electrode (e.g., a cathode electrode) of the light emitting element LD may be connected to the second power source VSS through a second power line PL2.

The first power source VDD and the second power source VSS may have different voltages (or potentials) so that the light emitting element LD may emit light. As an example, the first power source VDD may be a high-potential pixel power source, and the second power source VSS may be a low-potential pixel power source having a voltage that is lower than a threshold voltage of the light emitting element LD compared with the potential of the first power source VDD.

When the driving current is supplied from the pixel circuit PXC, the light emitting element LD generates light with a luminance corresponding to the driving current. Therefore, each pixel PX may emit light with a luminance corresponding to the data signal DS during each frame period DF. Meanwhile, in the case of the pixel PX that receives the data signal DS corresponding to the black gray scale (e.g., 0 gray) during the frame period DF, the first transistor M1 is turned off to generate no driving current. Therefore, the pixel PX may maintain the non-emission state during the frame period DF.

In some embodiments, the light emitting element LD may be a light emitting diode including an organic or inorganic light emitting layer. For example, the light emitting element LD may be an organic light emitting diode, an inorganic light emitting diode, a quantum dot/well light emitting diode, etc., but the present disclosure is not limited thereto.

In addition, although FIG. 5 illustrates some embodiments in which the pixel PX includes one light emitting element LD, the present disclosure is not limited thereto. For example, the pixel PX may include a plurality of light-emitting elements LD connected in series, in parallel, or in series-parallel with each other.

That is, in the present disclosure, the type, structure, shape, size, number, and/or connection structure of the light emitting elements LD are not particularly limited, and these may be variously changed according to embodiments.

The pixel circuit PXC may be connected between the first power source VDD and the light emitting element LD. In addition, the pixel circuit PXC may be further connected to the first, second, and third gate lines GL1, GL2, GL3, the data line DL, and the initialization power line INL of the pixel PX. The first, second, and third gate signals SC, SS, and BI supplied from the first, second, and third gate lines GL1, GL2, and GL3 may control the driving timing of the pixel PX, and the data signal DS supplied from the data line DL may control the emission luminance of the pixel PX. The voltage of the initialization power source VINIT is supplied to the initialization power line INL. In some embodiments, the second gate line GL2 and the initialization power line INL may also be respectively used as a sensing control line and a sensing line for sensing characteristic information of the pixels PX, but the present disclosure is not limited thereto.

The pixel circuit PXC may include a first transistor M1, a second transistor M2, a third transistor M3, a fourth transistor M4, and a capacitor Cst.

The first transistor M1 is connected between the first power source VDD and the light emitting element LD, and a gate electrode of the first transistor M1 is connected to a first node N1. The first transistor M1 drives the light emitting element LD by controlling the driving current supplied to the light emitting element LD according to the voltage of the first node N1. That is, the first transistor M1 may be a driving transistor for controlling the driving current of the pixel PX according to the voltage of the first node N1.

The second transistor M2 is connected between the data line DL and the first node N1, and a gate electrode of the second transistor M2 is connected to the first gate line GL1. The second transistor M2 may be driven according to the voltage of the first gate line GL1. For example, when a first gate signal SC of a gate-on voltage (e.g., a scan signal of a high level voltage) is supplied to the first gate line GL1, the second transistor M2 is turned on to electrically connect the data line DL to the first node N1.

The data signal DS of the frame is supplied to the data line DL during each frame period DF (e.g., each horizontal period), and the data signal DS is transmitted to the first node N1 through the second transistor M2 turned on during the period in which the first gate signal SC is supplied. That is, the second transistor M2 may be a switching transistor for transmitting the data signal DS of each frame to the inside of the pixel PX.

The capacitor Cst is connected between the first node N1 and the second node N2, and charges a voltage corresponding to a voltage difference between the first node N1 and the second node N2. The first node N1 may be a gate node to which the gate electrode of the first transistor M1 is connected, and the second node N2 may be a node between the first transistor M1 and the light emitting element LD. That is, the capacitor Cst may be a storage capacitor that is connected between one electrode (e.g., the source electrode) of the first transistor M1 and the gate electrode of the first transistor M1, and stores a gate-source voltage of the first transistor M1.

The third transistor M3 is connected between the second node N2 and the initialization power line INL, and the gate electrode of the third transistor M3 is connected to the second gate line GL2. The third transistor M3 may be driven according to the voltage of the second gate line GL2. For example, when a second gate signal SS of a gate-on voltage (e.g., an initialization control signal (or a sensing control signal) of a high level voltage) is supplied to the second gate line GL2, the third transistor M3 is turned on to electrically connect the second node N2 to the initialization power line INL. Therefore, the voltage of the initialization power source VINIT may be transmitted to the second node N2.

The fourth transistor M4 is connected between the first node N1 and the second node N2, and the gate electrode of the fourth transistor M4 is connected to the third gate line GL3. For example, the fourth transistor M4 may be directly connected between the first electrode and the second electrode of the capacitor Cst. That is, the fourth transistor M4 may be connected in parallel to the capacitor Cst between the first node N1 and the second node N2.

The fourth transistor M4 may be driven according to the voltage of the third gate line GL3. For example, when a third gate signal BI of a gate-on voltage (e.g., a non-emission control signal of a high level voltage) is supplied to the third gate line GL3, the fourth transistor M4 is turned on to connect the first node N1 to the second node N2. When the fourth transistor M4 is turned on, both electrodes of the capacitor Cst may be connected to become equipotential, and accordingly, charges accumulated in the capacitor Cst may be discharged.

Meanwhile, although FIG. 5 illustrates that the transistors included in the pixel circuit PXC, for example, the first to fourth transistors M1 to M4 are all N-type transistors, but the present disclosure is not limited thereto. That is, at least one of the first to fourth transistors M1 to M4 may be changed to a P-type transistor. In this case, the level of the gate-on voltage for turning on the corresponding transistor may be changed.

For example, in other embodiments, the first to fourth transistors M1 to M4 may be P-type transistors. In this case, the gate-on voltage for turning on the first to fourth transistors M1 to M4 may be a low level voltage.

In other embodiments, the pixel PX may include both a P-type transistor and an N-type transistor. For example, some of the first to fourth transistors M1 to M4 may be N-type transistors, and the others thereof may be P-type transistors.

Additionally, the position of the capacitor Cst may be changed according to some embodiments. For example, the capacitor Cst may be connected between the first power line PL1 (or the source electrode of the first transistor M1 changed to the P-type transistor) and the first node N1.

Figure 6:
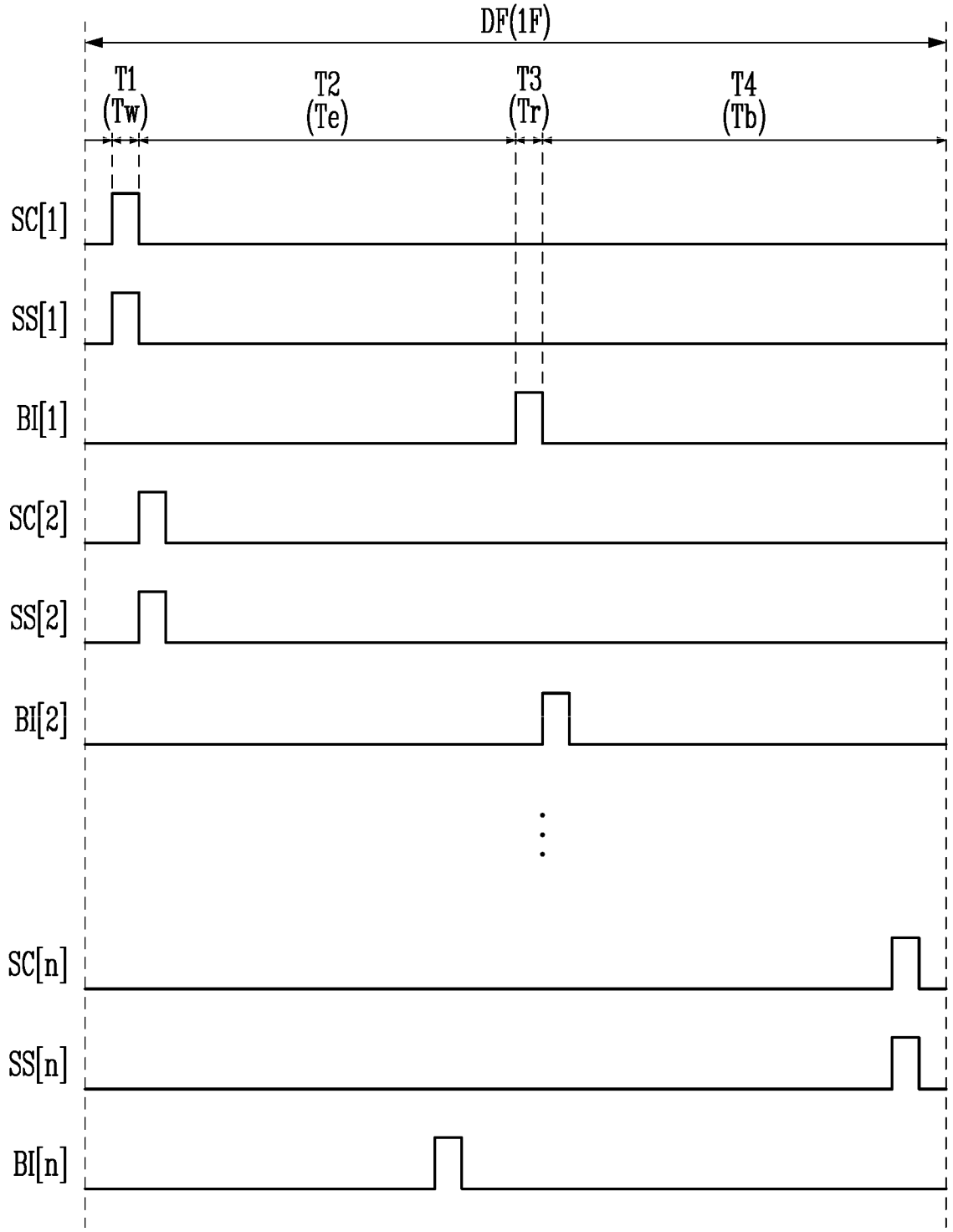
FIG. 6 illustrates a driving timing of a pixel according to some embodiments of the present disclosure.

FIG. 6 illustrates driving timing of the pixel PX according to some embodiments of the present disclosure. For example, FIG. 6 illustrates some embodiments of the first, second, and third gate signals SC, SS, and BI supplied to each pixel PX according to the embodiments of FIG. 5 (or FIG. 10).

For convenience, FIG. 6 illustrates the frame period 1F based on the pixels PX arranged on the first horizontal line HL[1] and the first to fourth periods T1 to T4 constituting the same. The first to fourth periods T1 to T4 for the remaining horizontal lines HL may be sequentially started subsequent to the first to fourth periods T1 to T4 for the first horizontal line HL[1].

Referring to FIGS. 1 to 6, the first gate signals SC[1] to SC[n] may be sequentially supplied to the first gate lines GL1[1] to GL1[*n*] during one frame period 1F. In addition, the second gate signals SS[1] to SS[n] may be sequentially supplied to the second gate lines GL2[1] to GL2[*n*] so as to be synchronized with the first gate signals SC[1] to SC[n] during one frame period 1F. For example, the first and second gate signals SC and SS may be simultaneously or substantially simultaneously supplied to the first and second gate lines GL1 and GL2 of each horizontal line HL.

For each horizontal line HL, one frame period 1F will include a first period T1, a second period T2, a third period T3, and a fourth period T4, which are sequentially continuous. In some embodiments, the first period T1, the second period T2, and/or the third period T3 of the current frame for some horizontal lines HL including the first horizontal line HL[1] and the like may temporally (e.g., in the time domain) overlap the second period T2, the third period T3, and/or the fourth period T4 of the previous frame for some other horizontal lines HL including the n-th horizontal line HL[n] and the like.

The first period T1 may be a period in which the data signals DS of the corresponding frame are input to the pixels PX of each horizontal line HL. For example, the first period T1 may correspond to the data input period Tw of FIG. 4.

During the first period T1, the first and second gate signals SC and SS may be simultaneously or substantially simultaneously supplied to the first and second gate lines GL1 and GL2 of the horizontal line HL. For example, the first and second gate signals SC[1] and SS[1] of the gate-on voltage may be supplied to the first and second gate lines GL1[1] and GL2[1] of the first horizontal line HL[1] during the first horizontal period of each frame period DF, and the first and second gate signals SC[2] and SS[2] of the gate-on voltage may be supplied to the first and second gate lines GL1[2] and GL2[2] of the second horizontal line HL[2] during the second horizontal period subsequent to the first horizontal period. In this manner, while sequentially supplying the first gate signals SC[1] to SC[n] of the first gate lines GL1[1] to GL1[*n*] of the plurality of horizontal lines HL[1] to HL[n] during each frame period DF, the second gate signals SS[1] to SS[n] may be sequentially supplied to the second gate lines GL2[1] to GL2[*n*] of the plurality of horizontal lines HL[1] to HL[n].

The second period T2 may be a period in which the pixels PX of each horizontal line HL emit light with a luminance corresponding to the data signals DS of the corresponding frame. For example, the second period T2 may correspond to the emission period Te of FIG. 4.

The third period T3 is a period in which the third gate signal BI is input to the pixels PX of each horizontal line HL, and may be a period in which the voltage charged in the pixels PX of the corresponding horizontal line HL is reset by the third gate signal BI. For example, the third period T3 may correspond to the data reset period Tr of FIG. 4.

For example, the third gate signals BI[1] to BI[n] may be sequentially supplied to the third gate lines GL3[1] to GL3[*n*] of the plurality of horizontal lines HL[1] to HL[n] during one frame period 1F. Therefore, the voltages stored in the pixels PX of the plurality of horizontal lines HL[1] to HL[n] during each frame period DF may be sequentially discharged, and the pixels PX may be reset.

For each horizontal line HL, the third gate signal BI may be supplied so as not to overlap the first and second gate signals SC and SS during each frame period DF. For example, the third period T3 may start when a time (e.g., a predetermined time) elapses from the start of the second period T2.

As the voltages charged in the pixels PX during the third period T3 is discharged, the pixels PX might not emit light during the fourth period T4 subsequent to the third period T3. For example, the fourth period T4 may correspond to the non-emission period Tb of FIG. 4. The pixels PX may maintain the non-emission state until the data signals DS of the next frame are supplied.

Figure 7:
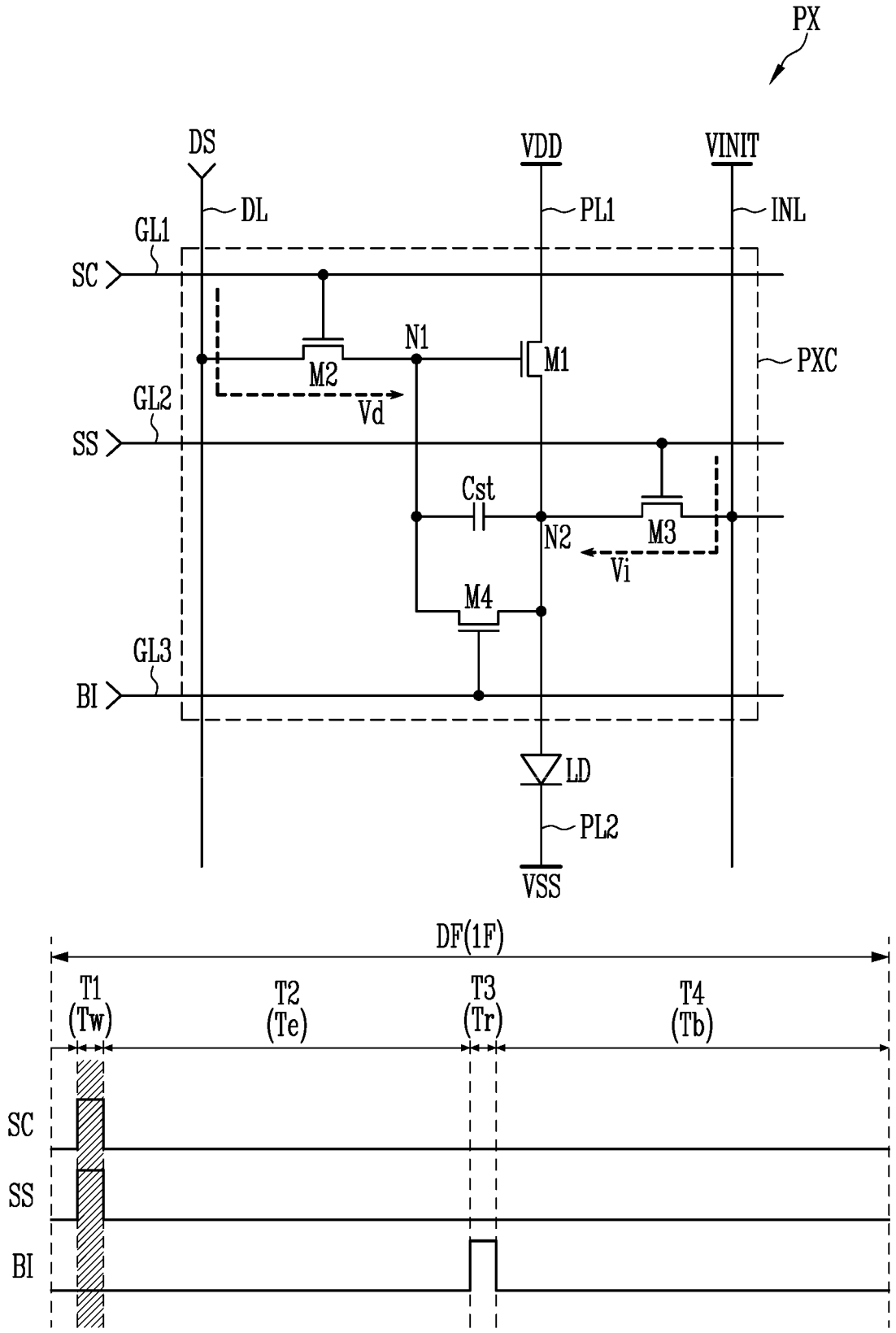
FIGS. 7 to 9 sequentially illustrate a method of driving a pixel, according to the embodiments of FIGS. 5 and 6.
Figure 8:
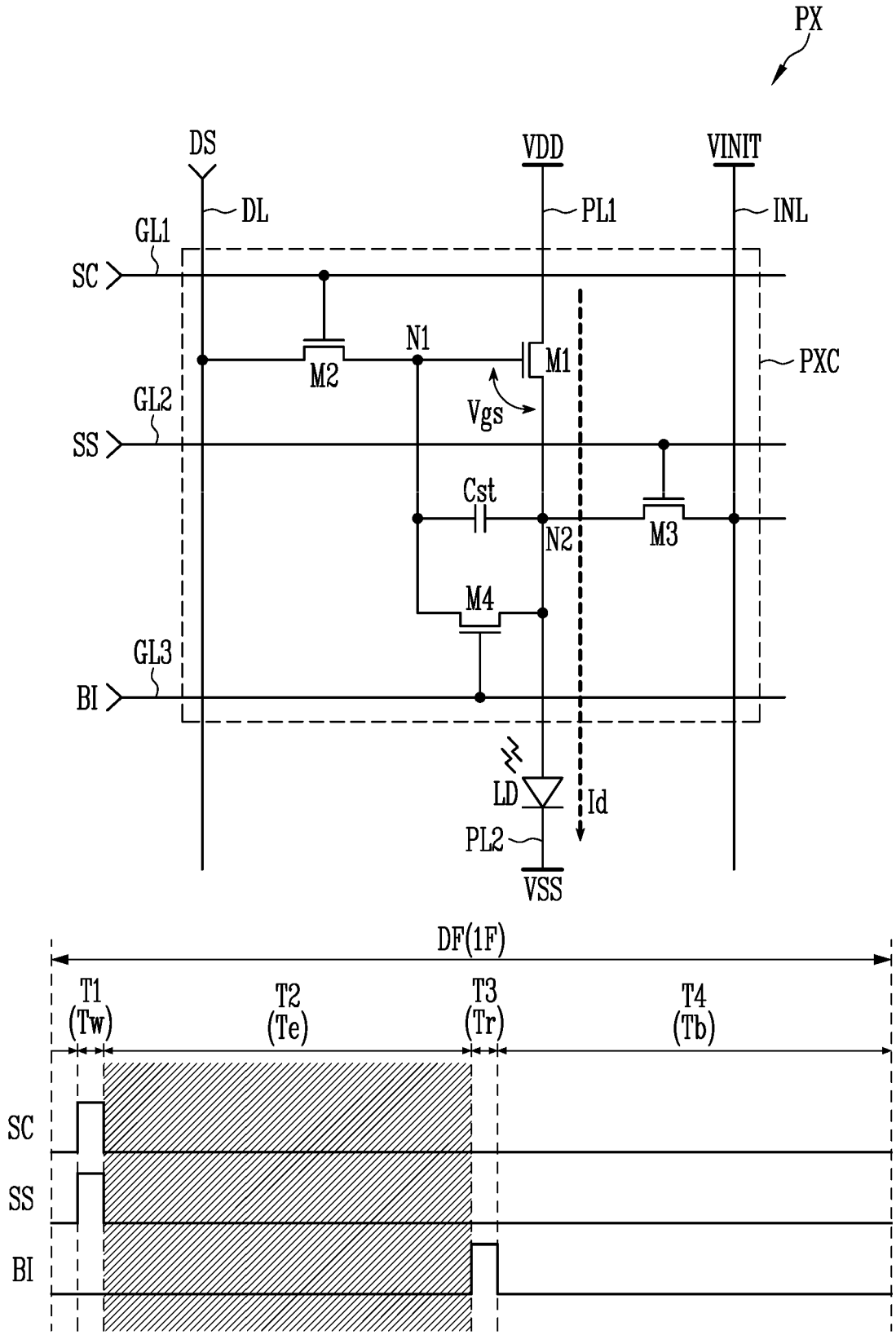
Figure 9:
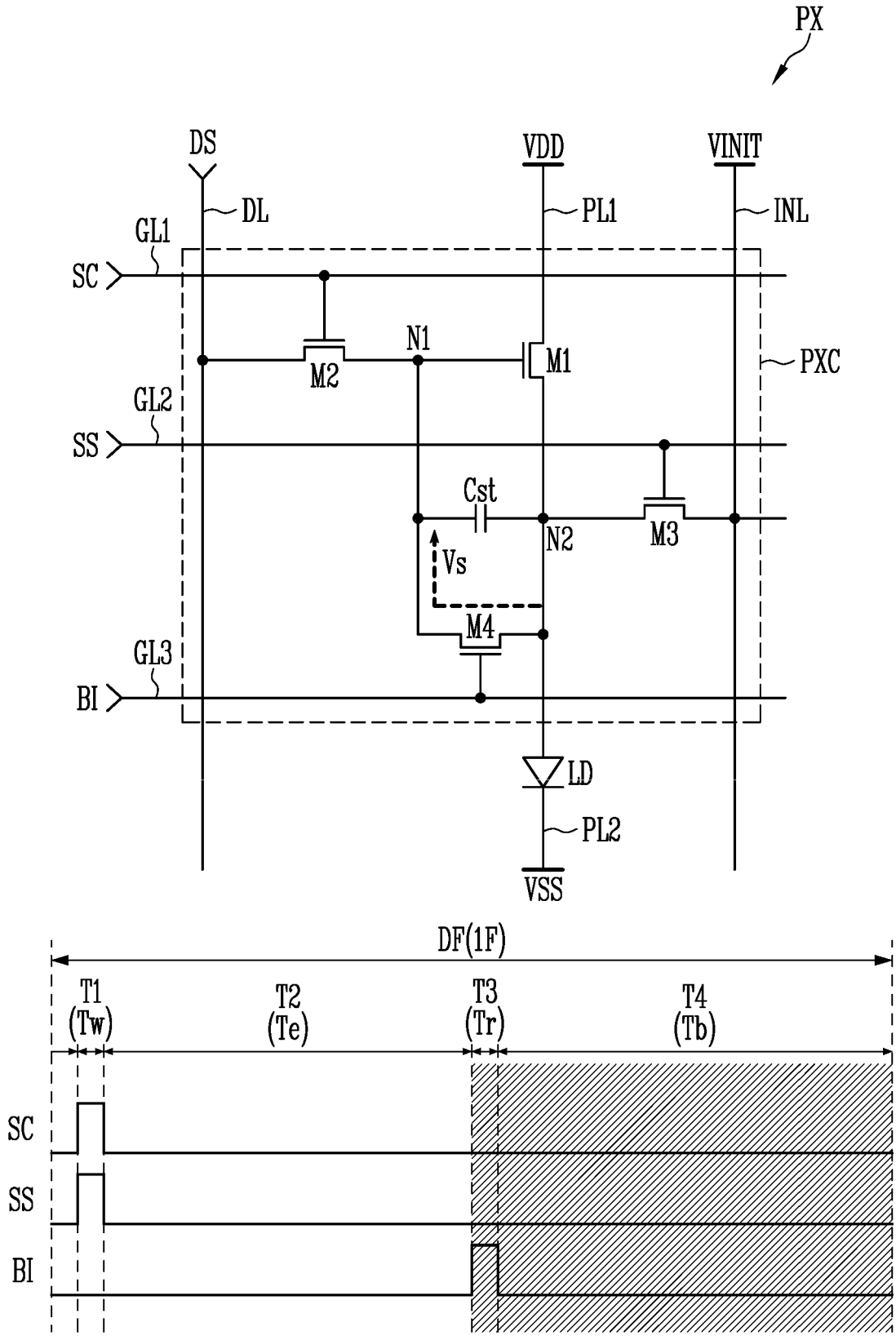

FIGS. 7 to 9 sequentially illustrate a method of driving a pixel PX, according to the embodiments of FIGS. 5 and 6. For convenience, FIGS. 7 to 9 illustrate some embodiments of one pixel PX arranged on an arbitrary horizontal line HL, and the first to third gate signals SC, SS, and BI supplied to the pixel PX.

First, referring to FIGS. 1 to 7, the first and second gate signals SC and SS of the gate-on voltage (e.g., the high level voltage) may be supplied to the first and second gate lines GL1 and GL2 of one horizontal line HL during the first period T1 of one frame period 1F. Therefore, the second and third transistors M2 and M3 of the pixels PX located on the horizontal line HL may be turned on.

When the second transistor M2 of each pixel PX is turned on, the data signal DS from the data line DL may be transmitted to the inside of the pixel PX, for example, the first node N1. When the third transistor M3 of each pixel PX is turned on, the voltage Vi of the initialization power source VINIT (hereinafter, referred to as "initialization voltage") from the initialization power line INL may be transmitted to the inside of the pixel PX, for example, the second node N2.

Therefore, the voltage (e.g., the voltage difference between the data voltage Vd and the initialization voltage Vi) corresponding to the voltage Vd (hereinafter, referred to as "data voltage") of the data signal DS may be stored in the capacitor Cst. In addition, as the initialization voltage Vi is transmitted to one electrode (e.g., the anode electrode) of the light emitting element LD, the light emitting element LD may be initialized. For example, charges accumulated in a parasitic capacitor of the light emitting element LD may be discharged.

Referring to FIGS. 1 to 8, the voltages of the first to third gate lines GL1, GL2, and GL3 of the horizontal line HL may be maintained at the gate-off voltage (e.g., the low level voltage) during the second period T2 subsequent to the first period T1. Therefore, the second, third, and fourth transistors M2, M3, and M4 of the pixels PX located on the horizontal line HL may be turned off.

During the second period T2, the gate-source voltage Vgs of the first transistor M1 may be maintained at the voltage charged in the capacitor Cst during the first period T1. Therefore, the first transistor M1 may generate the driving current Id corresponding to the data voltage Vd during the second period T2, and the driving current Id may flow from the first power source VDD to the second power source VSS through the first transistor M1 and the light emitting element LD. Therefore, during the second period T2, the pixels PX of the horizontal line HL may emit light with a luminance corresponding to the data signal DS. Meanwhile, the pixel PX receiving the data signal DS corresponding to the black gray scale during the frame period DF may maintain the non-emission state during the second period T2.

Referring to FIGS. 1 to 9, during the third period T3 subsequent to the second period T2, the third gate signal BI of the gate-on voltage (e.g., the high level voltage) may be supplied to the third gate line GL3 of the horizontal line HL. Therefore, the fourth transistors M4 of the pixels PX located on the horizontal line HL may be turned on.

When the fourth transistor M4 of each pixel PX is turned on, the off voltage may be applied to the first transistor M1 of the pixel PX. For example, the gate electrode and the source electrode of the first transistor M1 may be connected by the fourth transistor M4 during the third period T3, and thus the source voltage Vs of the first transistor M1 may be transmitted to the first node N1. In addition, both electrodes of the capacitor Cst connected between the gate electrode and the source electrode of the first transistor M1 may be connected to each other to become equipotential, and thus the capacitor Cst may be discharged. Therefore, the voltage of the first node N1 may be reset to the off voltage of the first transistor M1.

Thereafter, during the fourth period T4 subsequent to the third period T3, the voltages of the first to third gate lines GL1, GL2, and GL3 of the horizontal line HL may be maintained at the gate-off voltage (e.g., low level voltage). Therefore, the second, third, and fourth transistors M2, M3, and M4 of the pixels PX located on the horizontal line HL may be turned off.

During the fourth period T4, while the voltage of the first node N1 of the pixel PX is maintained, the gate-source voltage Vgs of the first transistor M1 may be maintained in a discharged state (e.g., 0V). Therefore, while the first transistor M1 is maintained in the off state during the fourth period T4, the pixels PX of the horizontal line HL may maintain the non-emission state.

Figure 10:
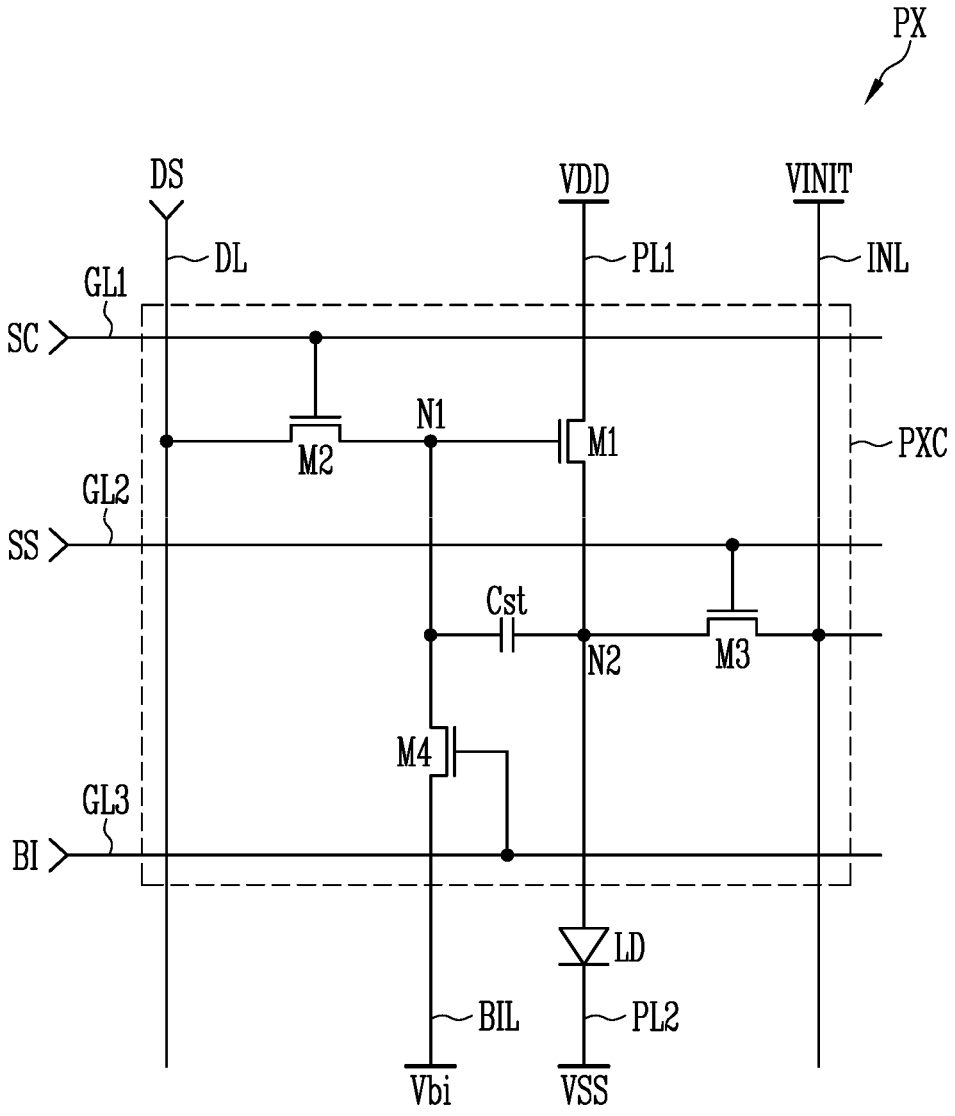
FIG. 10 illustrates a pixel according to some embodiments of the present disclosure.

FIG. 10 illustrates a pixel PX according to some embodiments of the present disclosure. For example, FIG. 10 illustrates a modification of the embodiments of FIG. 5 in relation to the fourth transistor M4.

Figure 11:
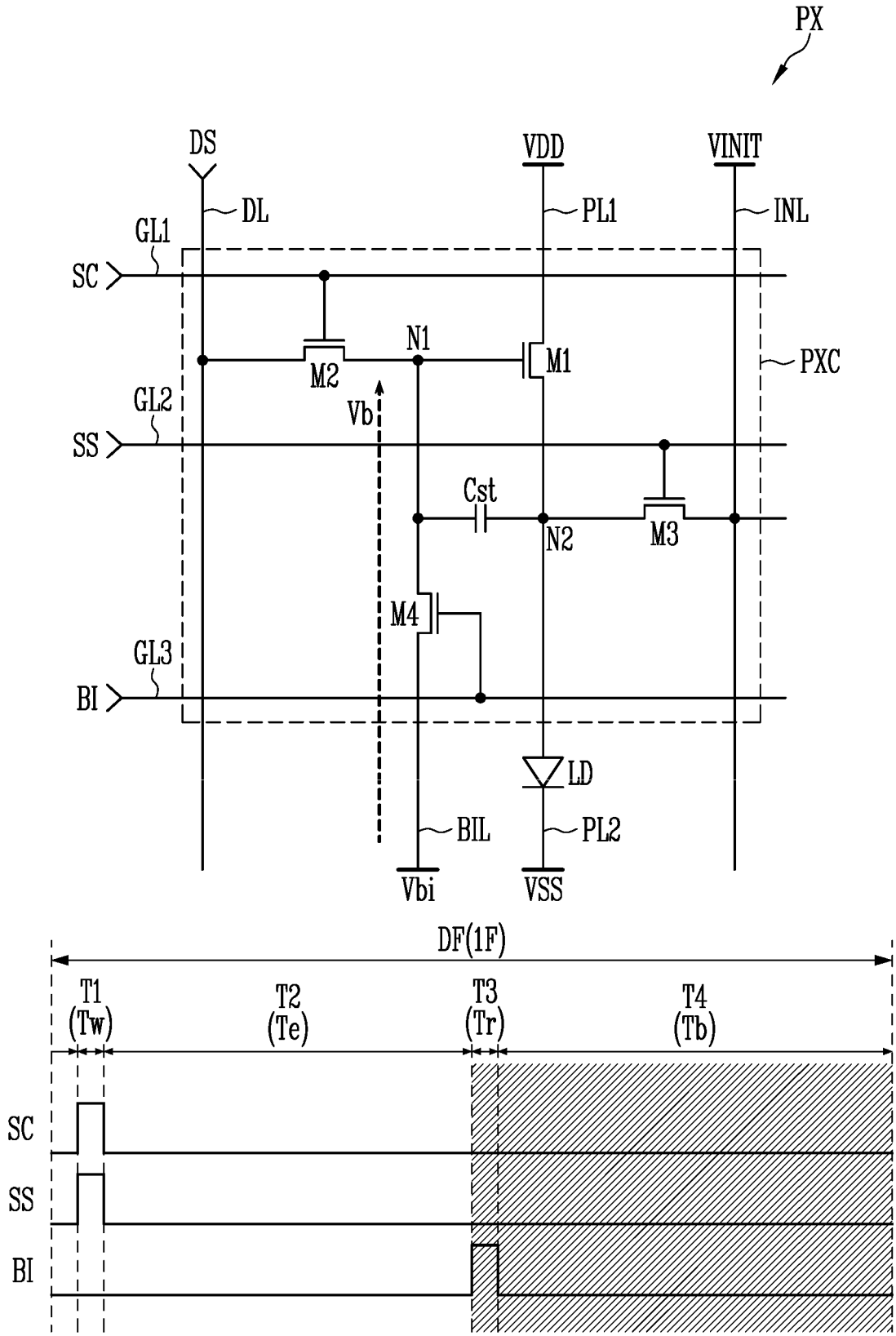
FIG. 11 illustrates a method of driving a pixel according to some embodiments of the present disclosure.

FIG. 11 illustrates a method of driving a pixel PX according to some embodiments of the present disclosure. For example, FIG. 11 illustrates a modification of the embodiments of FIG. 9 in relation to the operation in the third period T3 and the fourth period T4.

Figure 12:
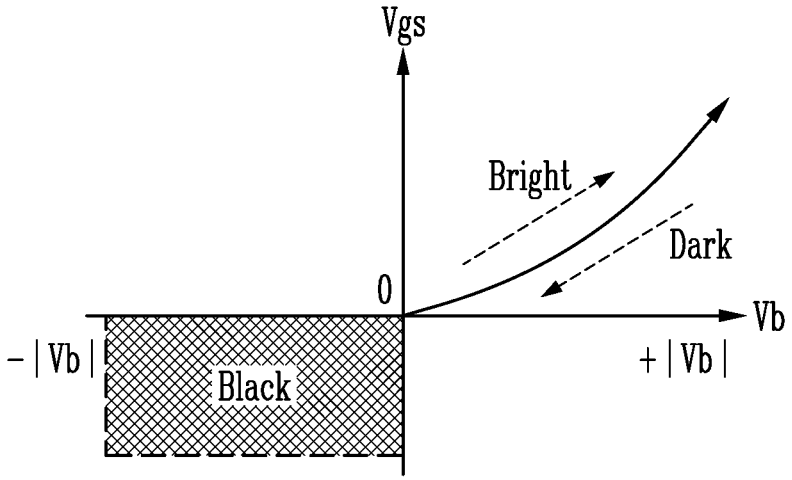
FIG. 12 illustrates a bias voltage and a driving voltage of a first transistor, according to some embodiments of the present disclosure.

FIG. 12 illustrates a bias voltage Vb and a driving voltage of a first transistor M1 according to some embodiments of the present disclosure. For example, FIG. 12 illustrates the bias voltage Vb, which may be applied to the pixel PX, and the gate-source voltage Vgs of the first transistor M1, according to the embodiments of FIG. 10.

In the embodiments of FIGS. 10 to 12, the same reference numerals are assigned to elements that are similar or identical to those of the embodiments of FIGS. 5 to 9, and detailed descriptions thereof will be omitted.

Referring to FIGS. 10 to 12 in conjunction with FIGS. 1 to 9, the fourth transistor M4 may be connected between the first node N1 and the bias power line BIL. For example, the fourth transistor M4 may be directly connected between the first node N1 and the bias power line BIL, and the bias voltage Vb may be transmitted to the first node N1 during the third period T3 in which the third gate signal BI is supplied to the third gate line GL3.

Because the bias power line BIL is connected to the bias power source Vbi and the fourth transistor M4 is turned on, the bias voltage Vb from the bias power source Vbi may be transmitted to the pixel PX. According to some embodiments, the bias power source Vbi may be an independent power source separated from the initialization power source VINIT, and may be a power source that is different from the initialization power source VINIT. In addition, the bias power line BIL may be a separate power line separated from the initialization power line INL. Therefore, the bias voltage Vb may be adjusted to a desired level, regardless of the initialization voltage Vi.

In some embodiments, the bias voltage Vb may be lower than or equal to the off voltage of the first transistor M1. For example, the bias voltage Vb may be an off voltage (e.g., a negative voltage) for resetting the gate-source voltage Vgs of the first transistor M1 to 0V or lower. In this case, because the first transistor M1 is turned off during at least the fourth period T4, the light emitting element LD does not emit light, and the pixel PX may express a black gray scale accordingly.

In other embodiments, the bias voltage Vb may be a low gray scale voltage that is less than or equal to a reference gray scale (e.g., a predetermined reference gray scale). For example, the bias voltage Vb may be a low gray scale voltage (e.g., a positive voltage having a small absolute value) of a level (e.g., a predetermined level) for finely turning on the first transistor M1. In this case, because the voltage of the first node N1 may be maintained at the low gray scale voltage during at least the fourth period T4, the first transistor M1 may be finely turned on. Therefore, the first transistor M1 may supply the driving current Id having a magnitude corresponding to the low gray scale voltage to the light emitting element LD, and the light emitting element LD may finely emit light with a luminance corresponding to the low gray scale voltage. Therefore, the pixel PX may emit light with a luminance corresponding to the low gray scale voltage, and an erasing operation of a display image may be performed as a low gray scale image corresponding to the low gray scale voltage (e.g., a gray image that is less than or equal to a gray scale (e.g., a predetermined gray scale)).

The gray scale displayed by each pixel PX during the fourth period T4 may change according to the bias voltage Vb, and the level of the bias voltage Vb may variously change according to embodiments. For example, the bias voltage Vb may be adjusted or set to a desired level according to various purposes of effectively compensating the change in characteristics due to hysteresis of the first transistor M1 and/or the change in characteristics due to deterioration of the light emitting element LD, of effectively correcting the luminance of the pixel PX in conjunction with luminance compensation according to external compensation, or effectively stably initializing the parasitic capacitor of the light-emitting element LD.

In addition, according to some embodiments, the horizontal lines HL may be divided into a plurality of groups each including at least one horizontal line HL, and bias voltages Vb of different levels may be supplied to each group. Therefore, black luminance (or a low gray scale luminance (e.g., a predetermined low gray scale luminance)) of the non-emission period Tb may be adjusted for each area, or the characteristic deviation of the pixels PX may be more precisely compensated.

Meanwhile, in the embodiments of FIGS. 10 to 12, the operation of the pixel PX during the first period T1 and the second period T2 may be substantially the same as the above-described embodiments. Therefore, a detailed description thereof will be omitted.

As described above, in the embodiments of FIGS. 10 to 12, the fourth transistor M4 may be connected to the bias power source Vbi configured as a separate independent power source, and the separate bias voltage Vb (e.g., the off voltage or the low gray scale voltage of the level (e.g., the predetermined level)) may be applied to the pixels PX of the horizontal line HL during the non-emission period Tb (or the low gray scale driving period) of each horizontal line HL. According to the above-described embodiments, the bias voltage Vb may be adjusted considering the desired purpose and/or the characteristics of the pixels PX. For example, the bias voltage Vb may be set to a voltage that is capable of effectively compensating the change in characteristics due to hysteresis of the first transistor M1, and/or the bias voltage Vb may be set to a voltage that is capable of effectively discharging the charges accumulated in the light emitting element LD to increase low gray scale expression. Therefore, image quality of the display panel may be improved and reliability may be improved.

In addition, according to the above-described embodiments, because the bias voltage Vb may be adjusted in units of at least one horizontal line HL, black (or gray) luminance may also be adjusted for each area. Therefore, by applying the optimized bias voltage Vb for each area according to the characteristics of the pixels PX, the image quality of the display device 100 may be improved, and the power consumption may be reduced or optimized.

According to embodiments of the present disclosure, the pixels PX may be turned off or driven in a low gray scale at a desired time point, regardless of the data input period of pixels PX located on each horizontal line HL. Therefore, while sufficiently securing the data input period, the image quality of the display device 100 may be improved by reducing or preventing the afterimage (e.g., motion blur).

In addition, according to embodiments of the present disclosure, the non-emission periods Tb may be sequentially inserted in a manner in which pixels are sequentially turned off or driven in a low gray scale in units of horizontal lines HL. Therefore, by distributing the load of the display panel and reducing, preventing, or minimizing the instantaneous current increase, the voltage drop and the increase in power consumption of the display panel may be reduced, prevented, or minimized.

Additionally, according to the embodiments in which the separate bias voltage Vb is supplied to the pixels PX of the corresponding horizontal line HL during the non-emission period Tb (or the low gray scale driving period) of each horizontal line HL, the bias voltage Vb may be controlled to a desired level. Therefore, it is possible to effectively compensate the change in the characteristics of the driving transistor, and to discharge the charges accumulated in the light emitting element LD, thereby increasing the ability to express low gray scales.

Aspects according to the embodiments are not limited by the above contents presented above, and more various aspects are incorporated in the present specification.

Although the present disclosure has been described in detail according to the above-described embodiments, it should be noted that the above embodiments are for the purpose of explanation and not for the limitation thereof. In addition, those of ordinary skill in the art will appreciate that various modifications can be made thereto within the scope of the present disclosure.

Therefore, the scope of the present disclosure should not be limited to the contents described in the detailed description of the specification, but should be determined by the appended claims. In addition, it should be construed that all changes or modifications derived from the meaning and scope of the claims and the functional equivalents thereof fall within the scope of the present disclosure.

What is claimed is:

1. A display device comprising: pixels; first gate lines, second gate lines, and third gate lines connected to the pixels; and data lines connected to the pixels, wherein at least one of the pixels comprises:

a light emitting element connected between a first power source and a second power source;

a first transistor connected between the first power source and the light emitting element for driving the light emitting element according to a voltage of a first node;

a second transistor connected between the first node and a corresponding data line, and configured to be driven according to a voltage of a corresponding first gate line;

a capacitor connected between the first node and a second node that is between the first transistor and the light emitting element;

a third transistor connected between the second node and an initialization power line, and configured to be driven according to a voltage of a corresponding second gate line;

a fourth transistor connected between the first node and the second node to be connected in parallel with the capacitor and to have an electrode connected to the light emitting element, and configured to be driven according to a voltage of a corresponding third gate line;

a gate driver for supplying first gate signals, second gate signals, and third gate signals to the first gate lines, the second gate lines, and the third gate lines, respectively, wherein the pixels are arranged on horizontal lines, wherein the first pate lines, the second pate lines and the third pate lines are arranged on respective horizontal lines and are connected to the pixels of the respective horizontal lines, wherein the pate driver is configured to concurrently supply the first and second gate signals to respective first and second gate lines of the horizontal lines for respective horizontal periods constituting one frame period, wherein the gate driver is configured to sequentially supply the first and second gate signals to the respective first and second gate lines of the horizontal lines in respective units of one of the horizontal lines during the one frame period, and wherein the gate driver is configured to, for one of the horizontal lines, supply a corresponding third pate signal to the corresponding third gate line when a time elapses after a corresponding first gate signal and a corresponding second pate signal are supplied to the corresponding first pate line and the corresponding second gate line during the one frame period.

2. The display device of claim 1, wherein the fourth transistor is directly connected between a first electrode and a second electrode of the capacitor, and is configured to connect the first electrode and the second electrode of the capacitor during a period in which a third gate signal is supplied to the corresponding third gate line.

3. The display device of claim 1, wherein the gate driver is configured to sequentially supply the third gate signals to the third gate lines of the horizontal lines in respective units of at least one of the horizontal lines during the one frame period.

4. The display device of claim 1, wherein the gate driver comprises:

a first gate driver for supplying the first and second gate signals to the first and second gate lines of the horizontal lines; and a second gate driver for supplying the third gate signals to the third gate lines of the horizontal lines.

5. The display device of claim 1, further comprising a data driver for supplying data signals corresponding to the pixels of a respective one of the horizontal lines to the data lines for a respective one of the horizontal periods.

6. A display device comprising:

pixels;

first gate lines, second gate lines, and third gate lines connected to the pixels; and data lines connected to the pixels, wherein at least one of the pixels comprises:

a light emitting element connected between a first power source and a second power source;

a first transistor connected between the first power source and the light emitting element for driving the light emitting element according to a voltage of a first node;

a second transistor connected between the first node and a corresponding data line, and configured to be driven according to a voltage of a corresponding first gate line;

a capacitor connected between the first node and a second node that is between the first transistor and the light emitting element;

a third transistor connected between the second node and an initialization power line, and configured to be driven according to a voltage of a corresponding second gate line; and a fourth transistor connected between the first node and a bias power line separated from the initialization power line, and configured to be driven according to a voltage of a corresponding third gate line, and to deliver a negative voltage as a bias voltage from the bias power line to the first node when turned on, wherein the fourth transistor is turned on by a corresponding third gate signal when a time elapses after the second transistor and the third transistor are respectively turned on by a corresponding first gate signal and a corresponding second gate signal in one frame period.

7. The display device of claim 6, wherein the fourth transistor is directly connected between the first node and the bias power line, and is configured to transmit a voltage of a bias power source to the first node during a period in which the third gate signal is supplied to the corresponding third gate line.

8. The display device of claim 7, wherein the voltage of the bias power source is configured to be set to an off voltage of the first transistor, or to a low gray scale voltage that is less than or equal to a reference gray scale.

9. The display device of claim 6, further comprising a gate driver for supplying first gate signals, second gate signals, and third gate signals to the first gate lines, the second gate lines, and the third gate lines, respectively, wherein the pixels are arranged on horizontal lines, wherein the first gate lines, the second gate lines and the third gate lines are arranged on respective horizontal lines and are connected to the pixels of the respective horizontal lines, and wherein the gate driver is configured to concurrently supply the first and second gate signals to respective first and second gate lines of the horizontal lines for respective horizontal periods constituting the one frame period.

10. The display device of claim 9, wherein the gate driver is configured to sequentially supply the first and second gate signals to the respective first and second gate lines of the horizontal lines in respective units of one of the horizontal lines during the one frame period.

11. The display device of claim 9, wherein the gate driver is configured to sequentially supply the third gate signals to the third gate lines of the horizontal lines in respective units of at least one of the horizontal lines during the one frame period.

12. The display device of claim 9, wherein the gate driver comprises:

a first gate driver for supplying the first and second gate signals to the first and second gate lines; and a second gate driver for supplying the third gate signals to the third gate lines.

13. The display device of claim 9, further comprising a data driver for supplying data signals corresponding to pixels of a respective one of the horizontal lines to the data lines for a respective one of the horizontal periods.

* * * * *